United States Patent [19]

Watts, Jr.

[11] 4,161,090

[45] Jul. 17, 1979

[54] POST ASSEMBLY AND METHOD

[76] Inventor: Ridley Watts, Jr., 34000 Cedar Rd., Gates Mills, Ohio 44040

[21] Appl. No.: 874,875

[22] Filed: Feb. 3, 1978

[51] Int. Cl.[2] ..... E04H 12/00

[52] U.S. Cl. ..... 52/301; 52/309.8; 52/514; 52/743

[58] Field of Search ..... 52/300, 301, 514, 244, 52/743, 309.5, 309.8, 309.1; 61/53; 138/96 R; 220/356, 357, 359, 69, 85.1 C

[56] References Cited

U.S. PATENT DOCUMENTS

| | | | |
|---|---|---|---|
| 1,996,401 | 4/1935 | Bowen | 52/301 |
| 2,450,343 | 9/1948 | Mervin | 52/301 |
| 3,228,334 | 1/1966 | Oss | 138/96 R X |
| 3,250,050 | 5/1966 | Finger et al. | 52/301 |
| 3,295,332 | 1/1967 | Dougherty | 61/53 |
| 3,319,328 | 5/1967 | Finger et al. | 52/301 X |
| 3,377,808 | 4/1968 | Dougherty | 52/301 X |

*Primary Examiner*—Price C. Faw, Jr.

*Assistant Examiner*—Carl D. Friedman

*Attorney, Agent, or Firm*—Watts, Hoffmann, Fisher & Heinke Co.

[57] ABSTRACT

A post assembly and method of capping a post, especially useful for pilings, e.g., as used for docks and the like. A covering over a post end is comprised of a semi-rigid, energy-absorptive, predominantly closed-cell body of foamed synthetic resin with a smooth continuous covering adhered thereto. In a preferred embodiment the covering is a thermoformed cap of predetermined size and shape, cushioned and adhered to the post by the foamed resin, and resistant to abrasion, impact, and ultraviolet deterioration. The foamed resin fills and seals all voids in the end of the post to prevent moisture from entering and deteriorating the post, and cushions and supports the cap to inhibit cracking or puncturing of the cap from impacts in use. The shape of the cap may be selected to provide a convex contour, as for pilings in coastal areas to prevent roosting of birds, and may bear indicia or be of various colors.

16 Claims, 10 Drawing Figures

POST ASSEMBLY AND METHOD

BACKGROUND OF THE INVENTION

1. Field of the Invention

This invention relates to posts or pilings and protective end caps.

2. Prior Art

Wooden posts and pilings deteriorate in use from exposure to weather, bacteria, fungii and insects. A primary cause of this deterioration is the entry of moisture at end surfaces of the post of piling, due to the exposed end grain. Moisture is carried into the post by capillary attraction and may cause the wood to rot or may become frozen and expand to cause cracks and structural defects that shorten the useful life of the post. This deterioration requires the replacement of posts or pilings at considerable expense and is a particular problem in docks and other structures in which posts and pilings are continually subjected to water and weather. While posts and pilings are typically treated chemically, this treatment does not inhibit deterioration to the extent desired.

In the past, various covers or caps for pilings have been suggested or used. These include bituminous material such as tar paper as a cushion on the top of a post, covered with a galvanized metal cap (U.S. Pat. No. 1,637,627), an asphalt covering and a metal cap screwed to the top of the post (U.S. Pat. No. 1,707,397), a steel or copper cover with screws in a flange covering a felt pad over the end of a post, the felt pad serving as a reservoir of preservative (U.S. Pat. No. 1,996,401), a cake of wood preservative on the end of a pole, covered by an elastic cap stretched over the top (U.S. Pat. No. 3,319,328), and a metal pile shoe with wings that fold around periphery of the post are nailed in place (U.S. Pat. No. 3,514,959).

The present state of the art to applicant's knowledge includes the use of fiber glass cloth impregnated with a slow cure resin that is layered upon and formed to the contour of the end of the post or piling. This covering tends to pull away during the cure and leaves voids between the post or piling end and the covering cloth and when unsupported and being somewhat brittle in nature, it tends to crack or be otherwise damaged from impacts. The state of the art also includes the use of a soft metal disk across the top of a piling, hammered into shape about the end and nailed in place around a skirt portion. Typically, the formed disk is not in intimate contact throughout its extent with the surface of the post or piling and therefore tends to be easily puncture. In the case of both such covers, substantial preservative is applied prior to covering the post or piling and the application of preservative and installation of either such cover will require substantial time, reportedly on the order of 45 minutes.

In addition to the above, it is known to set poles in the ground and fill the space between the pole and surrounding ground surfaces with an expanded foam resin (U.S. Pat. Nos. 3,403,520 and 3,564,859) or to encase the tip of a pile in concrete (U.S. Pat. No. 4,006,600).

SUMMARY OF THE INVENTION

The present invention provides an inexpensive protective end cover for posts and pilings that overcomes disadvantages of the prior art and which is strong and durable as well as easily and quickly applied. The protective cover effectively prevents entrance of moisture to the end of a post or piling and has the advantage of being attractive in appearance and lends itself to bearing indicia or having color significance. It can also provide an end shape substantially different from that of the post, such as a convex shape.

A preferred embodiment of the invention comprises a preformed plastic cap having good impact and abrasion resistance and resistant to ultraviolet deterioration. The cap has a top portion for covering the end of a post and a surrounding skirt that extends about a peripheral portion of the post at the covered end. The cap will typically be flat or convex, may bear insignia or other indicia on the top or sides, and may be of any desired color. The insignia, indicia or color can serve as indentification, advertisement, information, and the like, eliminating the need for separately posting notices or signs when desired on docks and the like. For example, posts indicating fueling docks can be color coded by selecting the cap of a desired color, and the cap can bear the logo of the fuel supplier, can display regulations, such as "no smoking," and the like. A convex cap can be used to prevent the roosting of seagulls or other birds.

The cap is larger than the end of the post and is secured to and spaced slightly from the end by a foam lining that is formed in place, is semi-rigid, and serves as an adhesive to adhere the cap to the post. The foam not only seals the space between the cap and post against the entrance of moisture, but also expands and fills all voids in the end of the post and between the cap and post. This semi-rigid foam serves as a cushion and provides total support and energy absorption beneath the cap to effectively inhibit puncturing or cracking of the cap from impact. In the event of puncture, as when a nail or the like is driven through the cap, the foam provides a gasket effect that seals the cap about the nail to prevent entrance of moisture to the wood. In addition, even if moisture enters, lateral spreading is prevented by the foam on the end surface of the post about the nail or nail hole.

As an alternative embodiment of the invention, the end of a post is protected by a foamed-in-place covering of semi-rigid, closed cell synthetic resin across the end and about the periphery of the post adjacent the end, and covered with either a synthetic plastic film adhered in place by the foamed material, or with a coating, such as a sprayed-on coating, that forms a thin skin on the foamed material. This end-covering provides protection against moisture and the like in installations where impact or abrasion are not factors or where posts or pilings are closely adjacent one another or other structures so that a cap of substantial thickness cannot be installed because of interference with the skirt.

A post and cap are assembled by mixing foam-forming chemicals and applying them between the end of a post and the cap and allowing the foam to form and expand between the two. The cap is maintained spaced slightly from the post and the expanding foam completely fills any crevices or cracks in the end of the post as well as the space between the post and cap. This assures that the end grain of the post is completely sealed from entry of moisture and provides a complete energy absorbing cushion and support for the cap.

Advantageously, the foamable material can be placed in the cap, swirled to cover most of the surface, and partially foamed before the cap is then placed over the end of the post. As the foam is formed, the cap must be held in place, slightly spaced from the post, against the expansion of the foam to force the foam to flow into all crevices, across the entire end surface of the post, and around the peripheral portion of the post between the post and skirt of the cap. This can be facilitated by placing an elastomeric ring, such as an O-ring, about the post adjacent the end to be capped. The O-ring is of a thickness sufficient to support the skirt of the cap and is located a distance from the end of the post slightly less than the depth of the skirt. The skirt will then rest against the elastomeric ring, with the top of the cap spaced from the end of the post. At the same time, the ring provides a seal about the skirt so that expanding foam will not extrude from beneath the cap. By holding the cap against the elastomeric ring during expansion of the foam, the foam is somewhat compressed and forced to expand into all available space between the post and cap. In a preferred embodiment, the elastomeric ring is square in cross section and is located by placing the cap against the end of the post and locating the elastomeric ring against the end of the skirt. The cap is then removed and the elastomeric ring is rolled toward the end of the post so the next adjacent flat surface of the O-ring engages the post. This locates the ring where it will support the cap above the end of the post a distance equal to the thickness of the O-ring. In this way ample space is provided for the foam and a degree of control of the space is afforded so the amount of foamable material needed can be estimated with some accuracy. After the foam was hardened, the ring can be removed.

The above and other features and advantages of the invention will become better understood from the detailed description that follows, when considered in connection with the accompanying drawings.

DETAILED DESCRIPTION OF PREFERRED EMBODIMENTS

Figure 1:
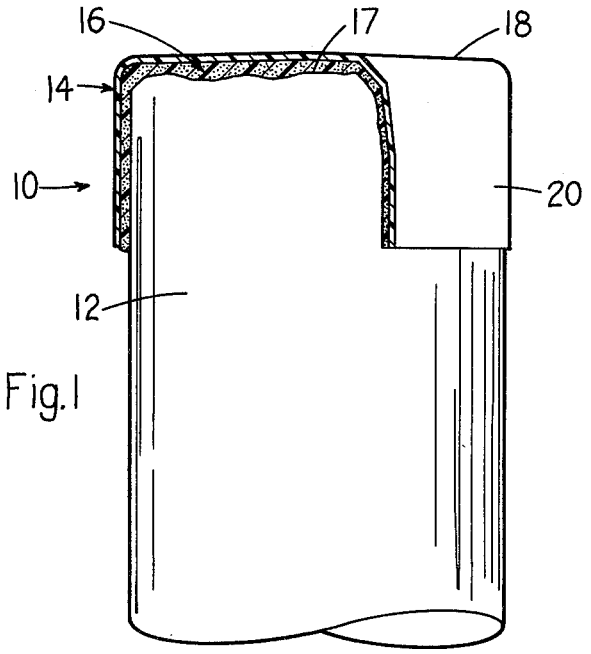
FIG. 1 is a side elevational view, with parts broken away, of a post and cap constructed in accordance with the present invention.

A preferred embodiment of the post assembly 10 of the present invention is shown in FIG. 1 of the drawings. The assembly comprises a post 12, a cap 14, and a foamed adhesive cushion 16 between the two.

In the embodiment of FIG. 1, the post 12 is a wooden post or piling as used for a dock, fence or the like. It is generally cylindrical and the wood grain runs longitudinally. The end grain of the post is exposed at each opposite end 17. The post is solid and chemically treated, as with creosote or the like, to inhibit deterioration. It should be understood that posts of other material and construction can be used to form the post assembly 10.

The cap 14 is larger than the end of the post 12 and provides a space between the cap and post for the foam cushion 16. The cap is of a tough material, resistant to impact, abrasion, and weathering. It is also of a material capable of being adhered by the foamed adhesive material 16. Advantageously, the cap 14 is of a thermoformed synthetic resin. In the embodiment shown in FIG. 1, the cap has a top portion 18 that is circular, and an integral, cylindrical, skirt portion 20.

A preferred material of which the cap 14 is made is acrylonitrile-butadiene-sytrene (ABS), such as Cycolac manufactured by Borg-Warner Corporation. A preferred thickness of the cap material 80–100 mils, (i.e., 0.080–10.100 inch). It is advantageous in some installations and for some purposes to provide a cap 14 in a particular color. This can be accomplished by applying a suitable acrylic cladding, which is advantageous because of its ultraviolet resistance and, hence, sunfast color. A suitable acrylic cladding is sold under the name Korad by Korad, Inc., a subsidiary of XCel Corporation. As an alternative to a clad ABS, the cap 14 can be made of cellulose acetate butyrate of an appropriate color. Such material is sold under the name Uvex by Eastman Chemical Products, Inc. Also urethane spray coatings are available that provide color and ultraviolet protection when applied to a plastic base, such as ABS.

The foamed adhesive cushion 16 is a semi-rigid foam that is expanded in place and is maintained under some pressure as it expands to assure that it fills all voids between the end of the post 12 and the cap 14, seals the end grain of the post, and fills the entire space between the cap and post end. The adhesive cushion is predominantly a closed-cell foam and serves as a support, underlying the cap and cushioning the cap from and absorbing the force of impacts. A suitable foam material is polyurethane of 4.5 pounds per cubic foot density. The preferred range of densities of the foam is 3.0 to 7.5 pounds per cubic foot to provide adequate ability at the lower density to withstand impact, and to still provide cushioning and impact absorption at the higher density. The polyurethane strongly adheres to both the cap and the post after it foams and effectively secures the cap to the post end in a sealed relationship.

Figure 2:
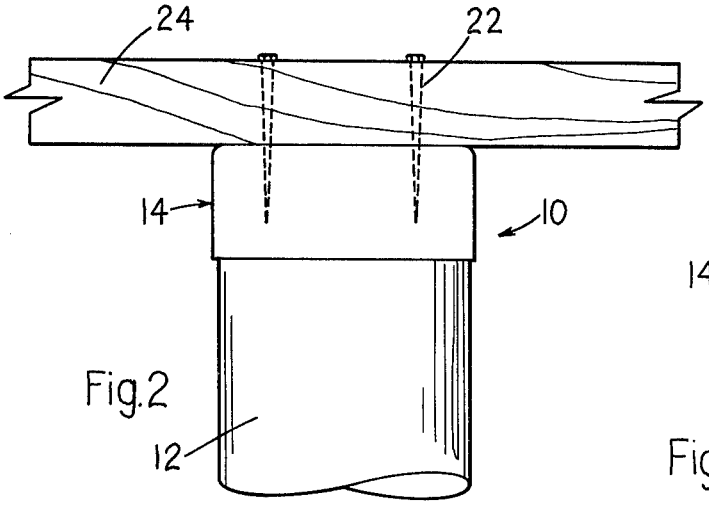
FIG. 2 is a side elevational view of a post and cap as shown in FIG. 1, illustrating the manner in which a cross member can be secured to the top of the post and cap.
Figure 3:
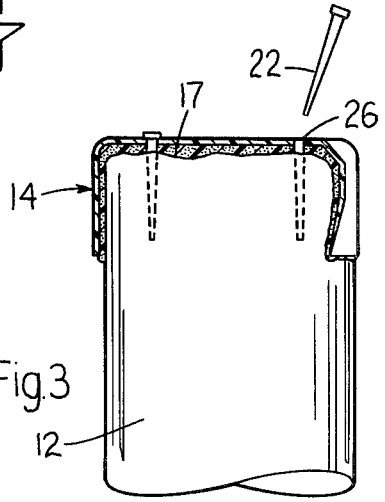
FIG. 3 is a side elevational view, with parts broken away, of an embodiment similar to FIG. 2, illustrating the manner in which the cap seals like a gasket about a spike or nail and the isolated nature of the hole or opening produced by a spike in the cap and post.

As shown in FIGS. 2 and 3, both the cap 14 and the foam 16 can be pierced by fasteners 22 such as lag screws or spikes for securing a cross piece, such as the member 24, to the end of the assembly 10. The elasticity of the cap 14 and the foamed adhesive cushion 16 provide a gasket effect about the fasteners to prevent entry of water or moisture. If the fasteners are removed, as illustrated in FIG. 3, the entry of water or moisture is limited to the area of the remaining hole 26. Lateral migration of water or moisture is prevented by the foam and the effective seal between the foam and the end surface 17 of the post.

To facilitate the variations in post diameter as well as irregularities in the shape of a natural product, such as a wooden post or piling, the caps 14 are provided in incremental sizes, for example, varying in one-half inch increments in diameter. For assembly, then, a cap is chosen that fits loosely over the end of a post, to assure space between the peripheral post surface and the skirt portion 20 of the cap for expansion and flow of the foam 16.

Installations of the cap 16 upon the end of a post is conveniently accomplished by introducing mixed chemicals that form the foam into the cap, tilting or rocking the cap to spread the chemical about the inside surface of the cap, and then placing the cap on the end of a post 12 while the chemicals foam. The cap must be retained over the end of the post against the expansion force of the foam to assure that the foam will spread throughout the space between the post and cap will enter all crevices of the post so the end grain is completely sealed and the cap completely supported and cushioned. The cap must be spaced from the end 17 of the post at all locations to assure complete cushioning.

Figure 4:
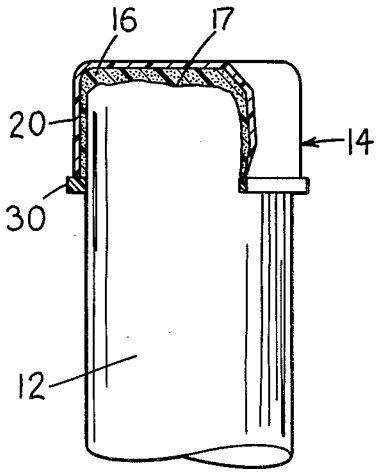
FIG. 4 is a side elevational view, with parts broken away, illustrating the manner in which a cap is supported above the end of a post during assembly.

As shown in FIG. 4, a preferred way of spacing the cap 14 from the end of a post 12 to assure a continuous cushion of foamed adhesive 16 is to place an elastomeric band 30, such as an O-ring, about the post at a distance from the end 17 less than the depth of the skirt portion 20. The O-ring must have a thickness radially of the post to extend a distance sufficient to support the edge of the skirt portion. In this manner and with the arrangement as shown in FIG. 4, the O-ring not only supports the cap spaced from the end 17 of the post, but also confines the expansion of the foaming adhesive to the zone beneath the cap, preventing it from extruding beyond the skirt of the cap. In addition to assuring a neater appearance, this also assures that the foam is held under pressure to expand peripherally of the cap if necessary to completely fill the zone around the skirt, rather than extruding from beneath the skirt at one location while failing to fill a void beneath another portion. During expansion of the foam, the cap must be held under external force against the O-ring 30.

In a preferred embodiment, the O-ring 30 has a square cross section as shown in FIG. 4. With such a construction, the O-ring can be positioned accurately by placing the cap 14 flush against the end of the post and placing the O-ring about the post at the edge of the skirt. The cap is then removed and the O-ring is rolled toward the end of the post a distance of one surface (i.e., one of the flat sides of the O-ring), or more, depending upon the space desired between the end of the post and the cap. Because the width of each side of the O-ring is known and the distance it is rolled upwardly easily observed, the gap provided between the end 17 of the post and the cap can be readily established. The cap is then replaced over the end of the post, resting against the O-ring, while the adhesive foam expands. By knowing the approximate gap provided, a relatively accurate estimate of the amount of chemical needed to form the foam can be made so that adequate adhesive foam material is provided to completely fill the void, without using an undue excess. After the foaming has stopped, the O-ring is removed.

Figure 5:
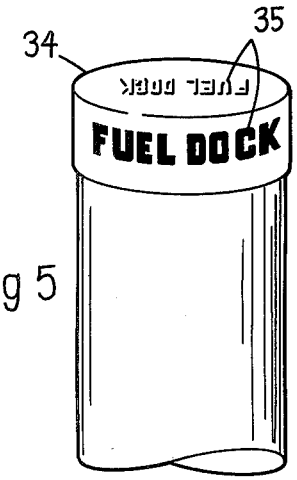
FIG. 5 is a perspective view of a post and cap illustrating another embodiment of the cap bearing indicia.

A modified embodiment of a cap 34 constructed in accordance with the present invention is shown in FIG. 5 of the drawings. The cap bears indicia 35, which in this case, is raised and is conveniently formed during thermoforming of the cap. With raised indicia, a paint or other coating of contrasting color can be easily applied, as by rolling or stamping, to enhance the visibility of the indicia. Such indicia may be for identification, or information, or other purpose. In the embodiment shown in FIG. 5, for example, the indicia "Fuel Dock" identifies the dock or a portion of the dock adjacent the piling as a location for fueling and eliminates the need for additional signs that are typically attached to dock pilings.

Figure 6:
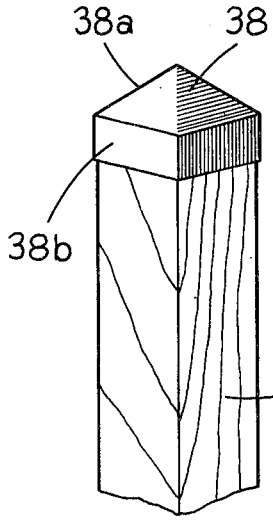
FIG. 6 is a perspective view of a post and cap illustrating a further embodiment of the cap, in convex form.

FIG. 6 shows a cap 38 illustrative of another embodiment of the invention. The cap 38 has a convex top **38*a*, in this case, pyramidal, with a square base and skirt 38*b*. It will be apparent that a dome shape cap could also be formed, as for use with a post of circular cross section and serve a decorative purpose or prevent the top surface of a post or piling from being used as a support or roost. As shown in FIG. 6, the cap 38 is on the end of a square post 40. While the convex portion 38*a* above the skirt portion 38*b* can be filled with adhesive foam that expands during assembly of the cap on the post, it is preferable to prefill the convex portion with foam material prior to installation. In such a case, the cavity formed by the skirt portion 38*b*** is of essentially the same volume as if a flat top surface were provided, minimizing the amount of foamed adhesive needed on site, for installation.

Figure 7:
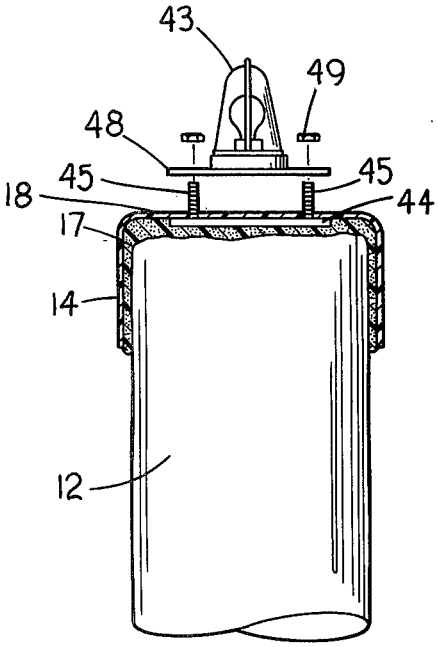
FIG. 7 is a side view, partly in elevation and partly in section, of a post and cap illustrating the manner in which an attachment can be secured.

As illustrated in FIG. 7, the cap 14 can be used to facilitate attachment of a fixture, such as the lamp 43. As shown, this is accomplished by providing a support plate 44 that is located between the cap and the end 17 of the post, embedded in the foamed adhesive cushion 16. Spaced screws 45 extend from the plate 44 through apertures in the top 18 of the cap. The foam adhesive 16 seals around the plate 44 and screws 45 to prevent entry of moisture or water or to isolate any infiltration of moisture or water from the end of the post 12. The lamp fixture 43 has a base 48 that receives the screws 45, and is secured by nuts 49 that thread onto the screws.

Figure 8:
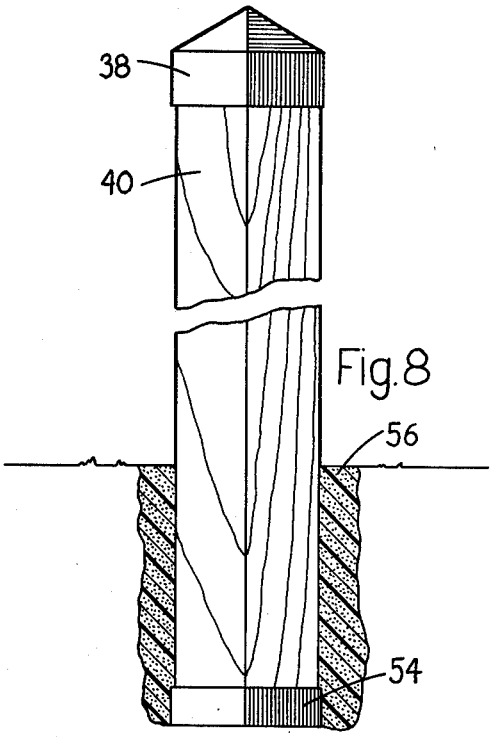
FIG. 8 is a side elevational view of a post having caps at opposite ends and supported in the ground.

While the caps previously described have been shown on an upper end of a post or piling, it will be apparent that caps of the same or similar construction can be used on the lower ends of pots or pilings that may be embedded into supporting terrain, such as sand, earth, or the like. FIG. 8 illustrates the manner in which a cap 54 (in this case square) is secured to the bottom end of a post 40, such as a fence post, to prevent entry of moisture into the end grain of the post, which is embedded in the soil. Typically, the remainder of the post beneath the ground level is surrounded by sand, concrete, foamed plastic, or the like 56 to support the post in an upright position. Where the surrounding material is concrete or foam, it also serves to help seal the portion of the post beneath the ground from the entry of moisture. However, it is well recognized that the surface of a post parallel to the grain resists entry of moisture to a much greater extent than the end, which extends across the grain, making it particularly advantageous to seal the lower end with the cap 54 and adhesive foamed cushion.

Figure 9:
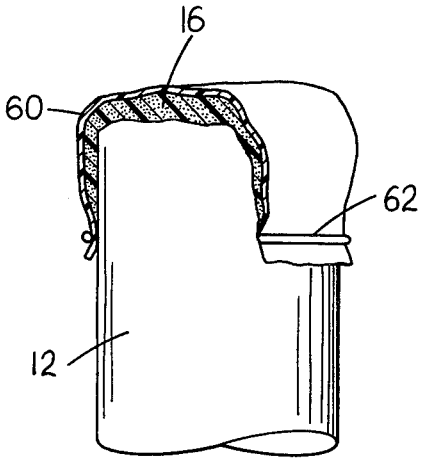
FIG.9 is a side elevational view, with parts broken away, illustrating a further embodiment of the invention.
Figure 10:
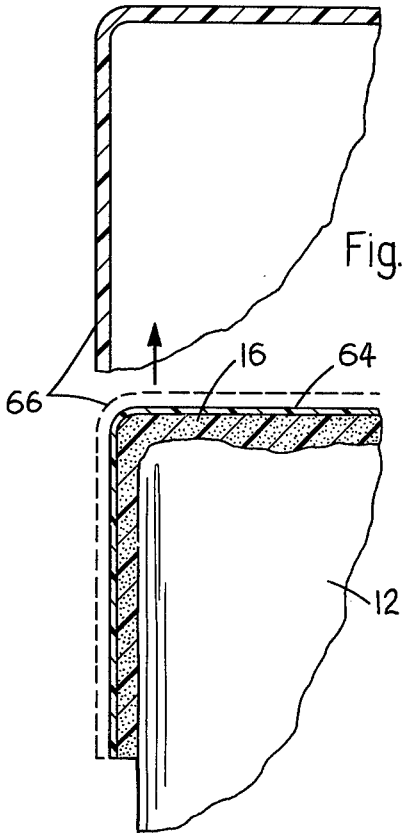
FIG. 10 is a partial side elevational view, with parts in section, illustrating an additional embodiment of the invention and the manner of fabricating it.

Another embodiment of the invention is shown in FIG. 9 of the drawings. The post 12 is covered by a cap 60 that covers a semi-rigid, closed-cell, synthetic resin foam 16. In this embodiment, the cap 60 is a thin and flexible synthetic plastic film in the form of a bag that is installed by pulling it, along with the mixed chemicals that form the foam, over the end of the post. The open end or skirt of the cap is sealed against the post by a strand or elastic band 62. This arrangement finds use where abrasion-resistance and impact strength are not important and where posts or pilings may be so close to adjacent structure that the thicker, more rigid skirt of a cap 14 may not fit between.

Where only sealing is needed, a layer of foam 16 can be used, with a cap 64 then formed over the foam by spraying the foam with a urethane finish, such as Chemglaze made by Hughson Chemical Division of Lord Corporation, Erie, Pa. The layer of foam is best established by using a preformed mold cap 66 similar to the cap 14 but of polyethane, which is more flexible than ABS and hence easier to apply over a post when it is close to adjacent structure that may tend to interfere with the cap placement. The polyethylene is also not adhered by the urethane foam. If desired, the mold cap 66 can be sprayed inside with a urethane finish that will transfer to fhe foam to form an outside coating 64. To form the layer of foam, the foamable materials are placed in the polyethylene cap 66 and the cap applied to the end of the post in the same manner as described in connection with the cap 14, but after foaming and partial hardening of the foam, the cap 66 is removed. If the urethane finish was not applied to the inside of the cap it is then applied to the now exposed surface of the foam to create an adhered, smooth, continuous protective cap-like covering 64 over the foam. Typically, because of the confinement of the foam during formation, it will form a smooth, dense, skin portion against the face of the mold cap 66 and the skin plus the finish coating 64 provide a smooth, relatively dense, surface of adequate strength where abrasion is not experienced.

While preferred embodiments of the invention have been disclosed in detail, it will be apparent that various modifications and alterations may be made therein without departing from the spirit and scope of the invention set forth in the appended claims.

What is claimed is:

1. A post assembly comprising:

a post with a solid or closed end, a cover extending across said end and about side portions of the post adjacent said end, said cover being spaced from said end, and a foamed, semi-rigid, energy-absorptive, adhesive completely filling the space between said cover and said end and adhering the cover to the post.

2. A post assembly as set forth in claim 1 wherein said cover is spaced from side portions of the post and said adhesive extends into the space between the cover and said side portions.

3. A post assembly as set forth in claim 2 wherein said cover is pre-formed to a predetermined size and shape, said space between the cover and said end and side portions being established by the predetermined size and shape, and the foamed adhesive being partially compressed within said space.

4. A post assembly as set forth in claim 3 wherein said shape includes a convex surface across the end of the post.

5. A post assembly as set forth in claim 2 including means secured between the cover and post end, in part extending through the cover, for securing an attachment to the cover.

6. A post assembly comprising:

a post with a solid or closed end, and a covering over said end, said covering comprising:

a semi-rigid, energy-absorptive, predominantly closed-cell, body of foamed synthetic resin covering said end and side portions of the post adjacent said end, said body having an essentially smooth outer skin, and a smooth continuous covering of synthetic resin adhered to said skin.

7. A post assembly as set forth in claim 6 wherein said covering is a coating.

8. A post assembly as set forth in claim 6 wherein said covering is a thin flexible film in the form of a bag.

9. In a method of protecting a pole end, the steps comprising:

providing a cap larger than the end to be protected, placing the cap over the pole end with inside surface portions of the cap spaced from the pole end, foaming and expanding a synthetic resin within the space between the cap and pole end, restraining the cap against movement from the pole end as a resin foams and expands, and allowing the resin to harden with the cap spaced from the pole end.

10. In a method as set forth in claim 9, the additional step of blocking egress of expanding resin from beneath the cap as the resin foams and expands.

11. In a method as set forth in claim 10, wherein the cap is externally supported in a position spaced from the pole end during foaming of the resin.

12. In a method as set forth in claim 9, the step of removing the cap after the resin has stopped expanding.

13. In a method as set forth in claim 9, the step of adhering the cap to the pole with the resin.

14. A post assembly, comprising:

a wooden post with a solid end, a thermoformed synthetic resin cap of predetermined shape and size larger than an end portion of the post it is adapted to cover, with a top portion covering one end of the post and a side portion encircling the post adjacent the end, said cap being highly resistant to impact, abrasion and ultraviolet deterioration and being spaced from the end and adjacent side portions of the post covered by the cap, and a foamed-in-place synthetic resin, semi-rigid and predominantly closed-cell, partially compressed within the space between the post and cap and filling essentially all voids therebetween and forming an impact-absorbing cushion and support between said cap and post, adhering the cap to the post, and sealing the space between the two against entry of moisture and air.

15. The assembly as set forth in claim 14 including an elastic ring encircling the post and extending radially outward a sufficient distance to engage the side portion of the cap, said ring locating the top portion of the cap spaced from the end of the post and closing the opening to the space between the cap and post.

16. In a method of capping a post, the steps comprising:

encircling the post with an elastomeric ring adjacent to but spaced from one end, providing an end cap that fits loosely over said end and having an end-cover portion and a surrounding skirt that extends from the end-cover portion a distance greater than the distance from the end of the post to the ring, placing foamable adhesive material within the cap and coating inside surface portions of the cap with the material, the amount of material being sufficient to fill the space between the end cover and the post after the material foams and expands, while the material is foaming and expanding, placing the cap on the end of the post with the skirt against the ring and the end-cover portion spaced from the end of the post, and holding the cap against the ring until the material stops expanding.

* * * * *